United States Patent [19]

Leuvering

[11] Patent Number: 5,039,276

[45] Date of Patent: Aug. 13, 1991

[54] METHODS AND APPARATUS FOR FORMING GROUPS OF OBJECTS

[75] Inventor: Hans Leuvering, Lubbecke, Fed. Rep. of Germany

[73] Assignee: Leifeld & Lemke Maschinenfabrik GmbH & Co. KG, Lubbecke, Fed. Rep. of Germany

[21] Appl. No.: 440,657

[22] Filed: Jun. 22, 1989

[30] Foreign Application Priority Data

Nov. 26, 1988 [DE] Fed. Rep. of Germany ..... 3839939

[51] Int. Cl.[5] ..... B65G 47/26; B65G 57/30

[52] U.S. Cl. ..... 414/795.3; 53/538; 53/541; 53/543; 198/418.5; 414/786

[58] Field of Search ..... 53/152, 153, 538, 541, 53/543; 198/418.3, 418.5, 436; 414/795.3, 786

[56] References Cited

U.S. PATENT DOCUMENTS

| | | | |
|---|---|---|---|
| 2,649,232 | 8/1953 | Ferguson et al. | 414/795.3 X |
| 2,834,167 | 5/1958 | Loveridge | 53/538 X |
| 3,403,792 | 10/1968 | Lape | 414/795.3 |
| 3,923,144 | 12/1975 | Langen | 53/543 X |
| 4,638,903 | 1/1987 | Kimura | 198/418.5 |

FOREIGN PATENT DOCUMENTS

| | | |
|---|---|---|
| 1112006 | 2/1962 | Fed. Rep. of Germany . |
| 1275954 | 7/1974 | Fed. Rep. of Germany . |
| 2502129 | 7/1976 | Fed. Rep. of Germany . |

*Primary Examiner*—Robert J. Spar
*Assistant Examiner*—Janice Krizek
*Attorney, Agent, or Firm*—Chilton, Alix & Van Kirk

[57] ABSTRACT

The grouping of objects, for example unit packaging goods, is accomplished by automatically assembling a stepped formation of the goods and subsequently leveling-off the stepped formation. To accomplish the foregoing, a serially increasing number of the goods are delivered in steps to a grouping station until a maximum number is reached and thereafter the number of goods per step is serially decreased. By exercising simultaneous control over the in-feed of goods and the shifting of the goods step-wise in a direction transverse to the in-feed direction after each delivery, finished groups having a predetermined size and configuration are formed at a downstream end of the grouping station and these finished groups are shifted out of the grouping station in the in-feed direction in synchronism with the in-feed of goods as the number of goods per step being fed in decreases.

18 Claims, 6 Drawing Sheets

METHODS AND APPARATUS FOR FORMING GROUPS OF OBJECTS

BACKGROUND OF THE INVENTION (1) Field of the Invention

The present invention relates to a method of and apparatus for the progressive step grouping of objects, for example unit packaging goods such as bottles or other containers, and particuarly to the stacking of such objects for their subsequent feed to a collator/packager. More specifically, this invention is directed to a grouping apparatus and technique wherein a stepped grouping of objects is initially automatically formed and the stepped grouping is then leveled-out automatically while sub-groups having the desired size and shape are transferred to downstream apparatus. Accordingly, the general objects of the present invention are to provide novel and improved methods of such character and apparatus for implementing such methods.

(2) Description of the Prior Art

Apparatus for stacking objects, such as unit packaging goods, are known in the art. In the typical prior art apparatus, the goods to be stacked travel on a conveyor in closed rows until reaching a stop and are then moved in rows by a lifting unit. Operation of the prior art apparatus may result in the formation of a partial stack which has a step-like or staggered configuration. In the prior art, in order to "level" the staggered grouping, i.e., to form a symmetrical stack as is customarily required for downstream apparatus such as collators or package fillers, manual labor was required. The need to manually complete the packaging stacks has been an expense which the packaging industry has long desired to eliminate.

SUMMARY OF THE INVENTION

The present invention overcomes the above-briefly discussed and other deficencies and disadvantages of the prior art by automating both the formation of a stepped grouping of objects at the start of a stacking process and the subsequent leveling-out of the stepped grouping at the end of the stacking process. In accordance with the present invention, the objects to be a grouped are released, from an in-feed conveyor, in a column or parallel columns such that the number of objects, i.e., the number of rows, in each column will serially increase from a minimum up to the maximum number of rows to be included in the grouping. In accordance with one embodiment, the released objects move on a conveyor of the grouping station to a first stop and, upon reaching the stop, are moved step-wise in a direction which is transverse to their in-flow direction. Subsequent to the number of rows released to the grouping station having reached the maximum number, and thus each release of objects thereafter being diminished from the number in the next previously released partial group, all of the rows are advanced in the in-flow direction by one step after each release. Thus, in order to achieve automatic leveling-out of the stepped grouping, all of the objects which have been moved transversely are advanced longitudinally by one step and, for as many rows of objects as then remain present at the grouping station, a further partial group is received at the grouping station and then moved transversely thus leveling-out the leading row whereupon it will be ejected from the grouping station upon the next longitudinal advance.

Apparatus in accordance with the present invention comprises a conveyor on which the in-flowing objects travel as far as a stop in order to form rows of the objects in a grouping station. The apparatus further comprises a transverse conveyor device which removes the individual rows of objects from the conveyor in a transverse direction to thus merge the objects which are in direct contact with the transverse conveyor with previously formed stepped partial groups of objects. The apparatus additionally includes a reciprocal stepped slide-bar mechanism which engages at least the uppermost object in each row of the stepped partial grouping which has been subjected to a shifting in the transverse direction. The slide bar mechanism, when activated, advances all of the rows of objects in a direction parallel to the in-flow direction and, in so doing, transfers the leading row out of the grouping station.

Apparatus in accordance with the present invention additionally comprises an in-feed conveyor which can be operated in accordance with a control program so as to be synchronized with the stroke of the transverse conveyor device. Accordingly, for the purpose of the automatic formation of the stepped grouping, the objects to be delivered to the conveyor of the grouping station are periodically released and the number of objects per release is serially increased up to a maximum. Subsequently, to achieve the automatic leveling-out of the stepped grouping, the in-feed conveyor is controlled so as to serially reduce the number of objects released during each delivery step.

BRIEF DESCRIPTION OF THE DRAWINGS

The present invention may be better understood and its numerous objects and advantages will become apparent to those skilled in the art by reference to the accompanying drawing wherein like reference numerials refer to like elements in the several figures and in which.

DESCRIPTION OF THE DISCLOSED EMBODIMENTS

With reference now to the drawings, objects to be stacked or grouped for subsequent transfer to a collator/packager are indicated at 1*a*. These objects, which hereinafter will be referred to as individual unit packaging goods, move from an in-feed conveyor 3 into a stacking station where they are merged, in the matter to be described below, by being raised. In the embodiment of FIGS. 1–12, the final grouping is formed by continuous stacking from below upwards and all of the partial stacks or rows are jointly advanced longitudinally at the end of the stacking procedure by means of a stepped slide bar mechanism which engages a completed row and all of the partial rows of the grouping or stepped stack from behind. The grouping procedure of the present invention proceeds in a continuous sequence from the in-feed of the first unit packaging goods to the discharge of the completed stack with minimum sequential cycles for all of the necessary conveyor devices. The present invention is also characterized by gentle treatment of the unit packaging goods and by apparatus which is characterized by a high degree of reliability.

Figure 12:
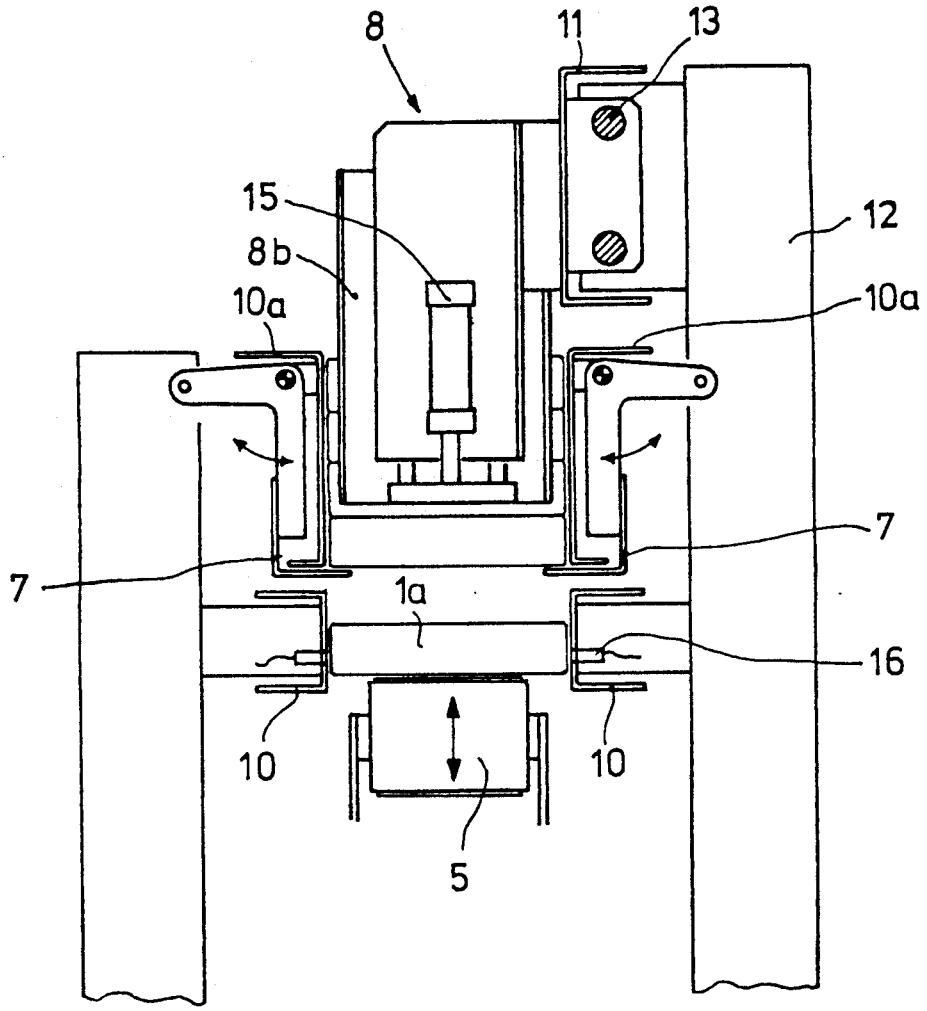
FIG. 12 is a front elevation view of the apparatus shown schematically in FIGS. 1–11.

The production of a symmetrical grouping of unit packaging goods in accordance with the invention requires the initial formation of a progressively stepped grouping of such goods. The automatic assembly of this stepped grouping is represented in FIGS. 1–5. Thus, as previously noted, the unit packaging goods 1*a* which are to be formed into packaging stacks for subsequent transfer to a collator/packager are fed to the grouping station by an in-feed conveyor 3 which, as will be described in more detail below, is operated in a controllable manner and includes a moveable barrier 4. The grouping apparatus includes a circulating, powered conveyor device 5 which is located immediately downstream of the conveyor 3. The conveyor 5 may be translated between a lower pick-up position, where it is shown in the drawings, and an upper discharge position, this translational movement being in a direction transverse to the direction of movement of the received unit packaging goods and being represented by a double-headed arrow. Retaining plates 7 (see FIG. 12) are provided for the purpose of capturing and holding the unit packaging goods la in a raised position. Referring to FIG. 12, the retaining plates 7 can be swiveled into and back out of the vertical path of movement of the conveyor device 5. It is to be noted that the operation of the barrier 4 and the transverse movement of the conveyor device 5 are synchronized and will customarily operate under program control.

The unit packaging goods 1*a* which are allowed to pass by the barrier 4, and thus reach the conveyor device 5, are conveyed to a stop 6 while their lateral alignment is maintained by means of guide plates 10 (see FIG. 12).

When each partial group of unit packaging goods which is allowed to pass barrier 4 reaches the stop 6, that partial group is raised by the conveyor device 5. The sensing of the presence or absence of unit packaging goods 1*a* on the conveyor device 5 is accomplished, in the disclosed embodiment, through the use of photoelectric detectors 16 which generate signals which are fed back to the program control for the barrier 4 and conveyor device 5. After the unit packaging goods 1*a* have been engaged by the retaining plates 7, the conveyor device 5 will return to its stand-by position in alignment with the in-feed conveyor 3. When the conveyor device 5 has returned to its stand-by position, and presuming proper operation with all of the photoelectric detectors indicating the absence of unit packaging goods on the conveyor device 5, the barrier 4 will be retracted so as to release the appropriate number of unit packaging goods 1*a* to the conveyor device 5.

Figure 1:
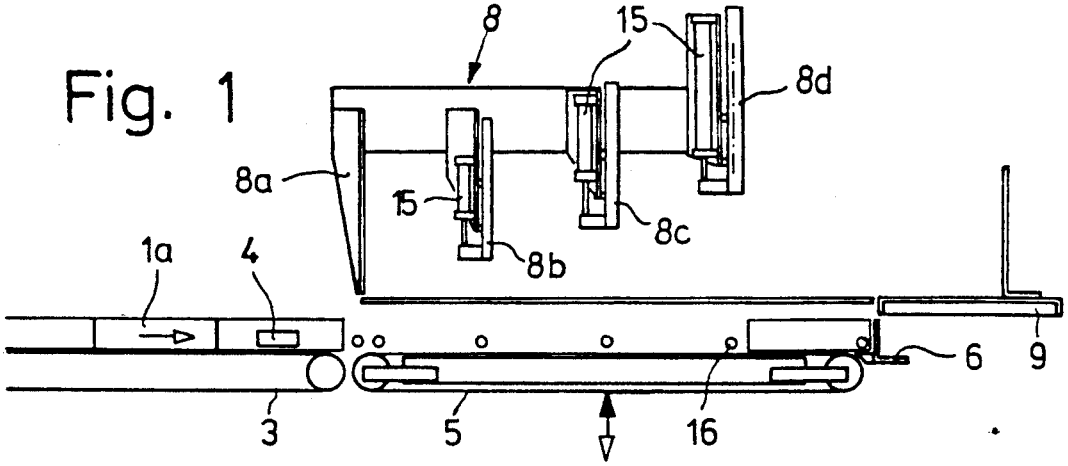
FIGS. 1–11 are schematic side-elevation views which depict the practice of a first enbodiment of the present invention in step-wise fashion, FIGS. 1–11 also schematically illustrating apparatus in accordance with a first embodiment of the invention.

As represented in FIG. 1, in accordance with the operation of the first embodiment of the present invention, in a first step a single packaging unit la is released by barrier 4 and conveyed in the in-feed direction as far as the stop 6. Thereafter, referring jointly to FIGS. 1 and 2, the packaging unit is raised and captured by retaining plates 7.

Figure 2:
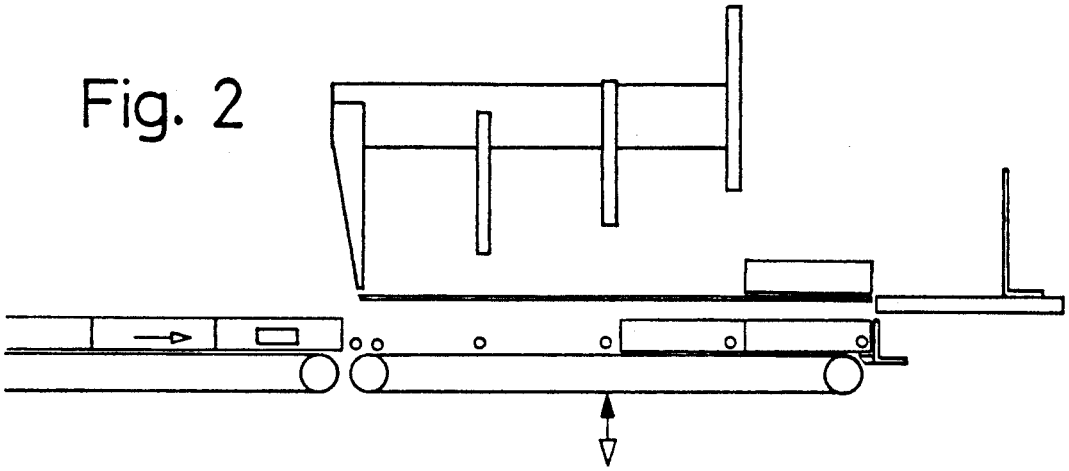
Figure 3:
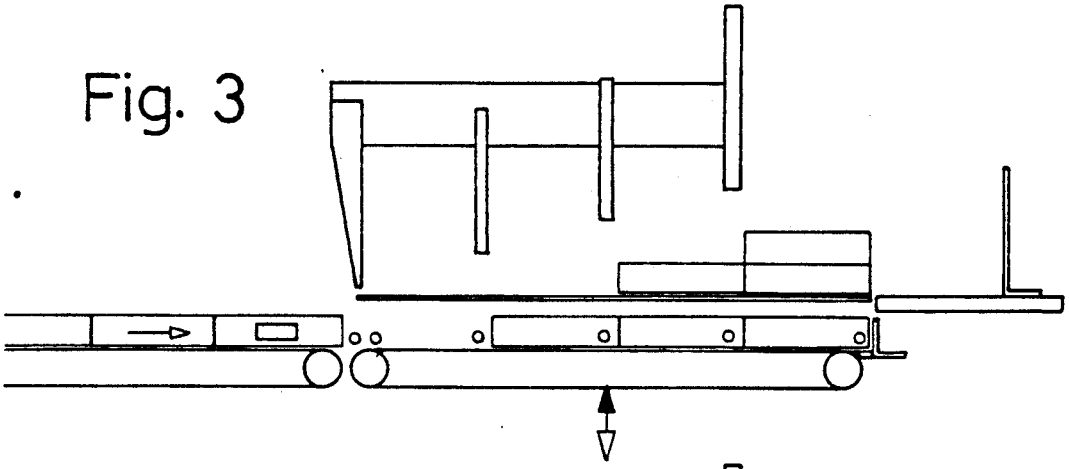

In a second step, represented by FIGS. 2 and 3, two packaging units 1*a* are released by barrier 4, conveyed to the stop 6, raised and captured by the retaining plates 7. During this second step, the leading packaging unit 1*a* in the direction of feed comes in contact with and raises the packaging unit which was already held in a raised position.

In a third step, three packaging units 1*a* are released, conveyed as far as the stop 6, raised and captured by the retaining plates 7. As may be seen by reference to FIGS. 3 and 4, the first two rows in the feed direction will, during the third step, be moved into contact with and thus will raise the stepped grouping defined by the first and second rows of goods which have previously been passed by barrier 4.

Figure 4:
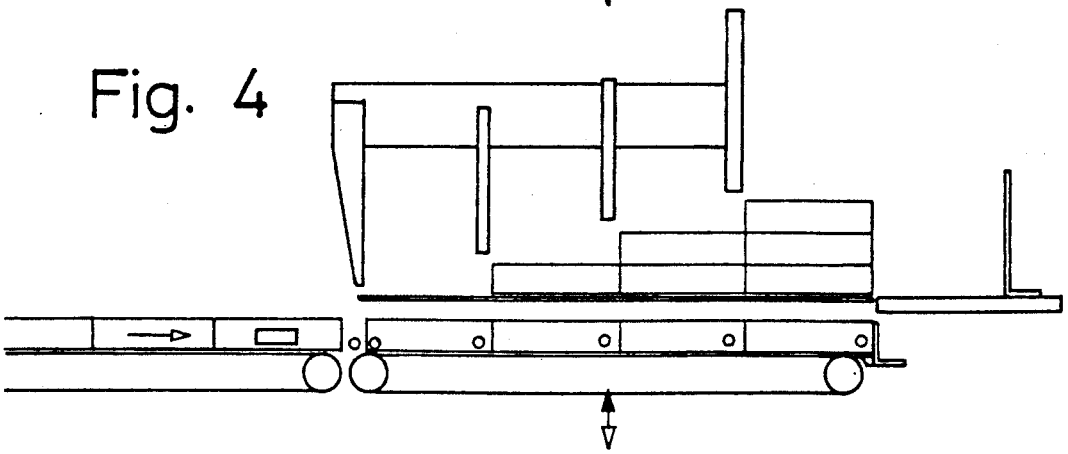

Next, referring to FIG. 4, the barrier 4 will release a column comprising four rows of packaging units. In the disclosed embodiment, each row is only one unit deep but it is to be understood that a row could be several units deep.

Figure 5:
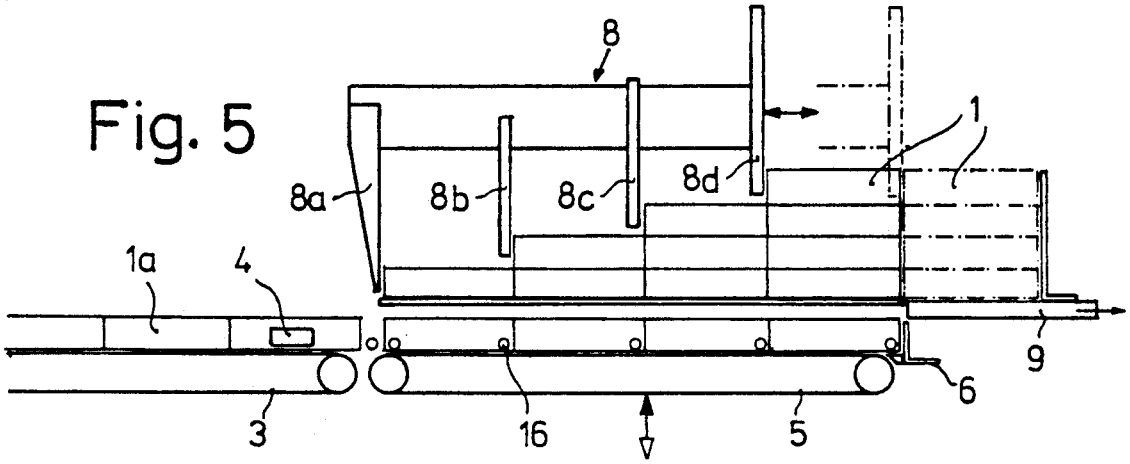
Figure 6:
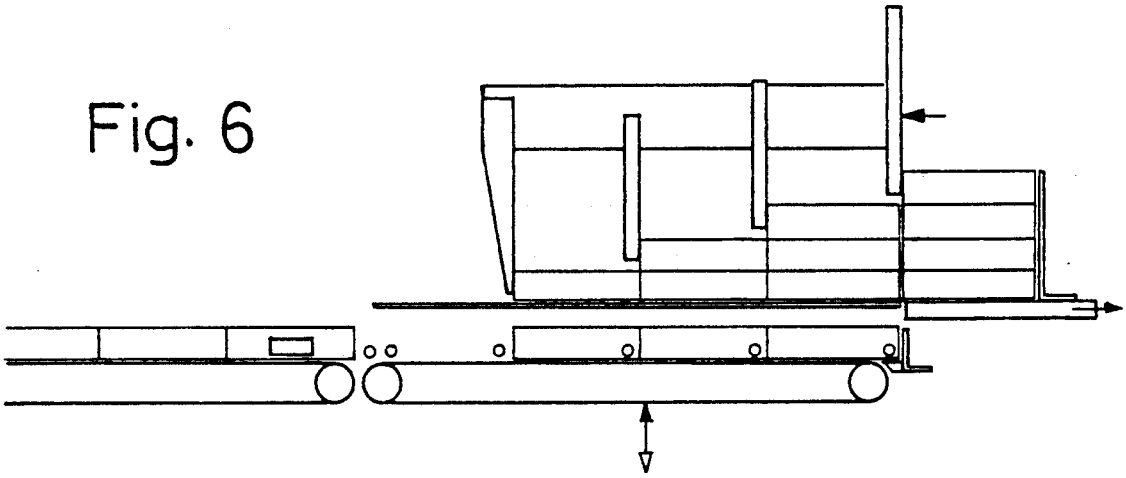

With reference to FIG. 5, it may be seen that the transverse movement of the four rows of packaging units results in the leading row defining a finished packaging stack 1. This finished stack may be transferred, through the action of a longitudinally reciprocating stepped slide bar assembly 8, onto a discharge table 9. The slide bar assembly 8 includes, in the arrangement where the finished packaging stack is four units high, four end dogs 8*a*–8*d* which respectively engage a single stack step. Through the action of the slide bar assembly 8, as a finished stack 1 is discharged, all of the partial stacks are advanced in the in-feed direction by one step so as to be in registration with subsequently delivered unit packaging goods which will engage the stop 6.

The discharge table 9 is capable of reciprocating travel in the longitudinal direction. Accordingly, the discharged packaging stack 1 can be placed a selected distance from a following packaging stack 1. This ensures problem-free feeding of the packaging stacks to a downstream collator/packager.

Referring again to FIG. 12, the stepped slide bar assembly 8 is mounted on a carriage 11 which is capable of reciprocating motion under the control of a suitable actuator means, not shown. The slide bar assembly moves on guide rails 13 which are mounted on the machine frame 12.

Figure 7:
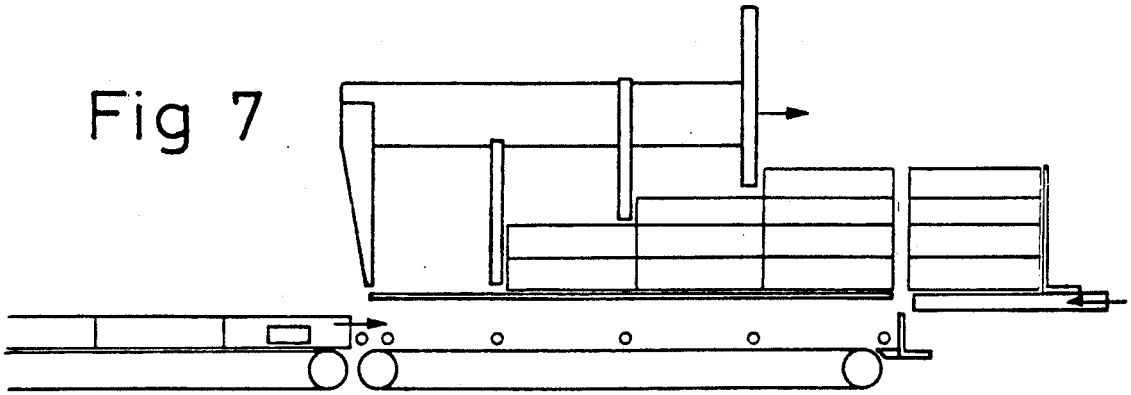
Figure 8:
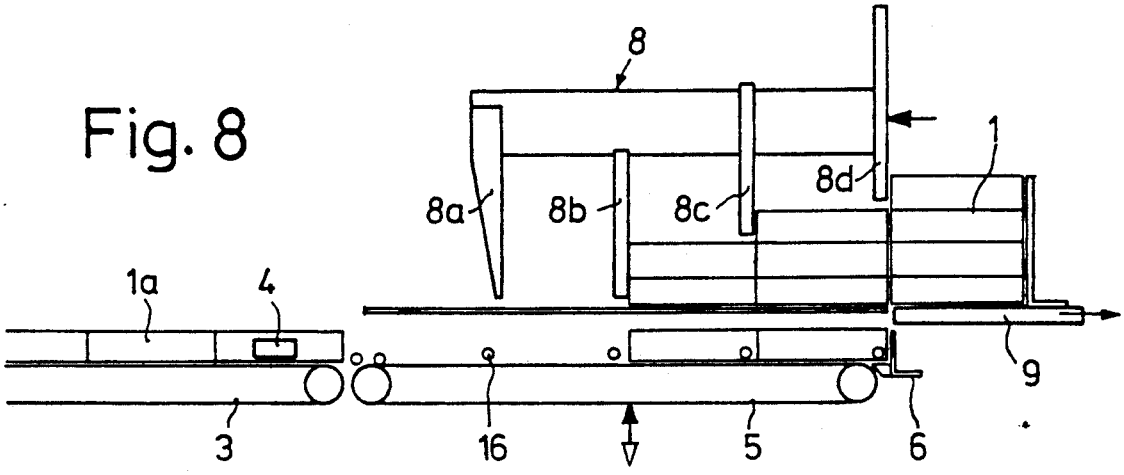
Figure 9:
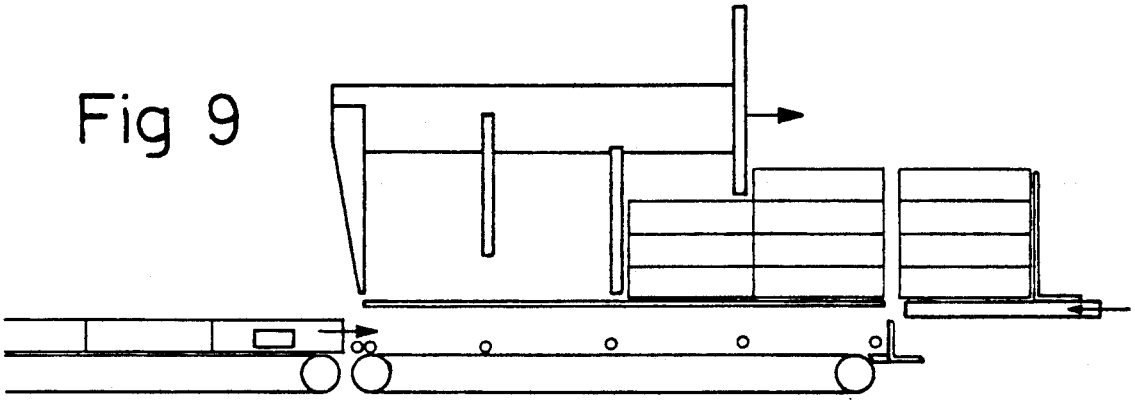
Figure 10:
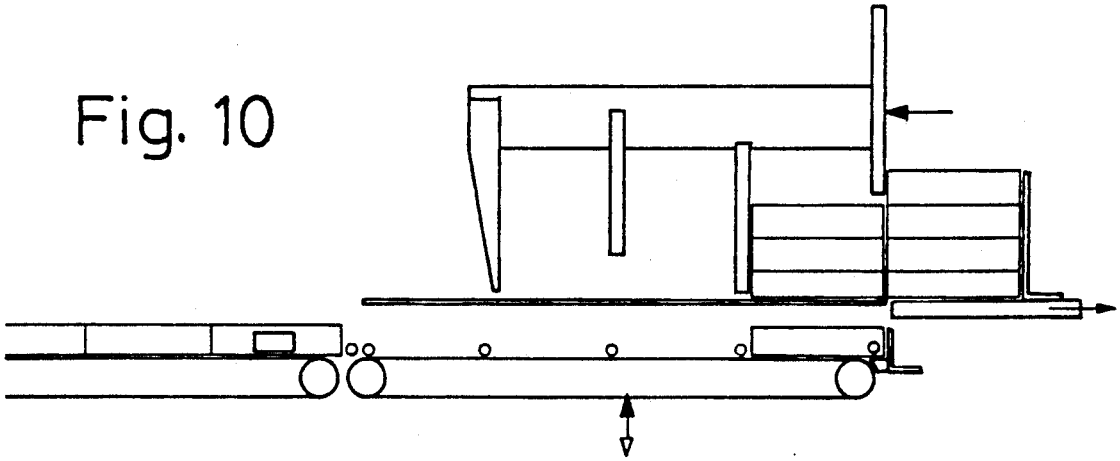
Figure 11:
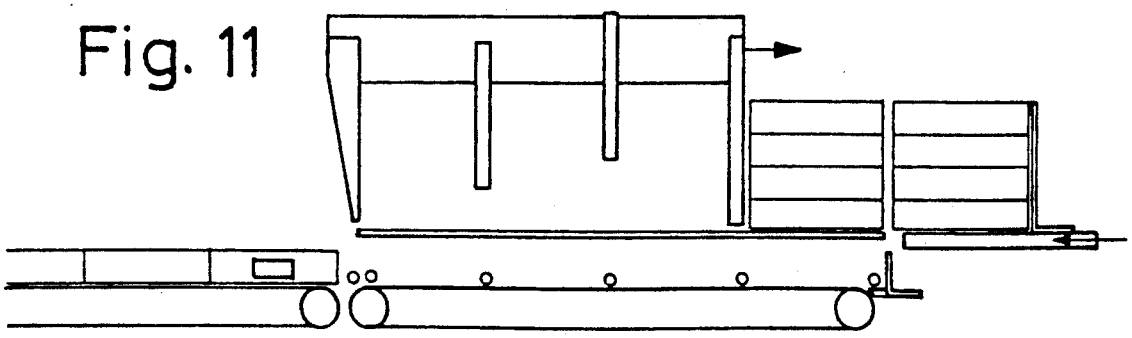

Referring now to FIGS. 6–11, the automatic leveling-out of the stepped formation, which may be seen in FIG. 5, is accomplished as follows. Once an initial packaging stack 1 is complete, all of the rows of the partially completed grouping are advanced by one step under the action of the slide bar assembly 8. The barrier 4 is then retracted to cause the delivery to conveyor device 5 of as many unit packaging goods 1*a* as there are partial groups present in the grouping station, i.e., the number of units released from conveyor 3 will be equal to the number of rows of goods 1*a* supported by the retaining plates 7. Thus, referring to FIG. 6, after a first packaging stack 1 has been moved onto the discharge table 9, the barrier 4 will be retracted to permit three packaging units 1*a* to move onto the conveyor device 5 and travel to the stop 6. These three packaging units will then be raised thus also raising the partial stack which is already being held in the raised position. As shown in FIG. 7, this will complete a second packaging stack 1 which, referring to FIG. 8, can be transferred by the stepped slide bar assembly 8 onto the discharge table 9. The procedure then continues, as depicted in FIGS. 9–11, until all of the rows have been formed into a completed packaging stacks and transferred to the discharge table 9. It may thus be seen that, during the assembly of the stepped grouping of FIG. 5, the number of rows of packaging units released by the barrier 4 will serially increase to a maximum and, during the leveling-out procedure, the number of rows released by the barrier 4 will serially decrease until the trailing row in the direction of packaging unit in-feed defines a complete packaging stack 1.

As may be seen by comparison of FIGS. 6–11, in order for the stepped slide bar assembly 8 to function properly, the length of the dogs **8*b*–8*d* must be adjustable. To this end, referring again to FIG. 12, these three dogs are mounted on the carriage 11 in guideways and are vertically moveable by individual actuators which may, for example, comprise pneumatic cylinders 15. The operation of these actuators will typically also be under supervision of the program control which receives the input from the detectors 16 and operates the barrier 4 and the up/down movement of the conveyor device 5**.

The detectors 16 are installed so as to function as light barriers which monitor the presence or absence of objects on the conveyor device 5. This ensures that the transverse movement of the conveyor device 5 will occur only when the proper number of packaging units **1*a* are positioned on the device 5**.

It is to be noted that, while the transverse conveyor device 5 has been shown as being in the form of a continuous belt, the device 5 could also be in the form of a roller conveyor with a lift device(s) located between the rollers.

Figure 13:
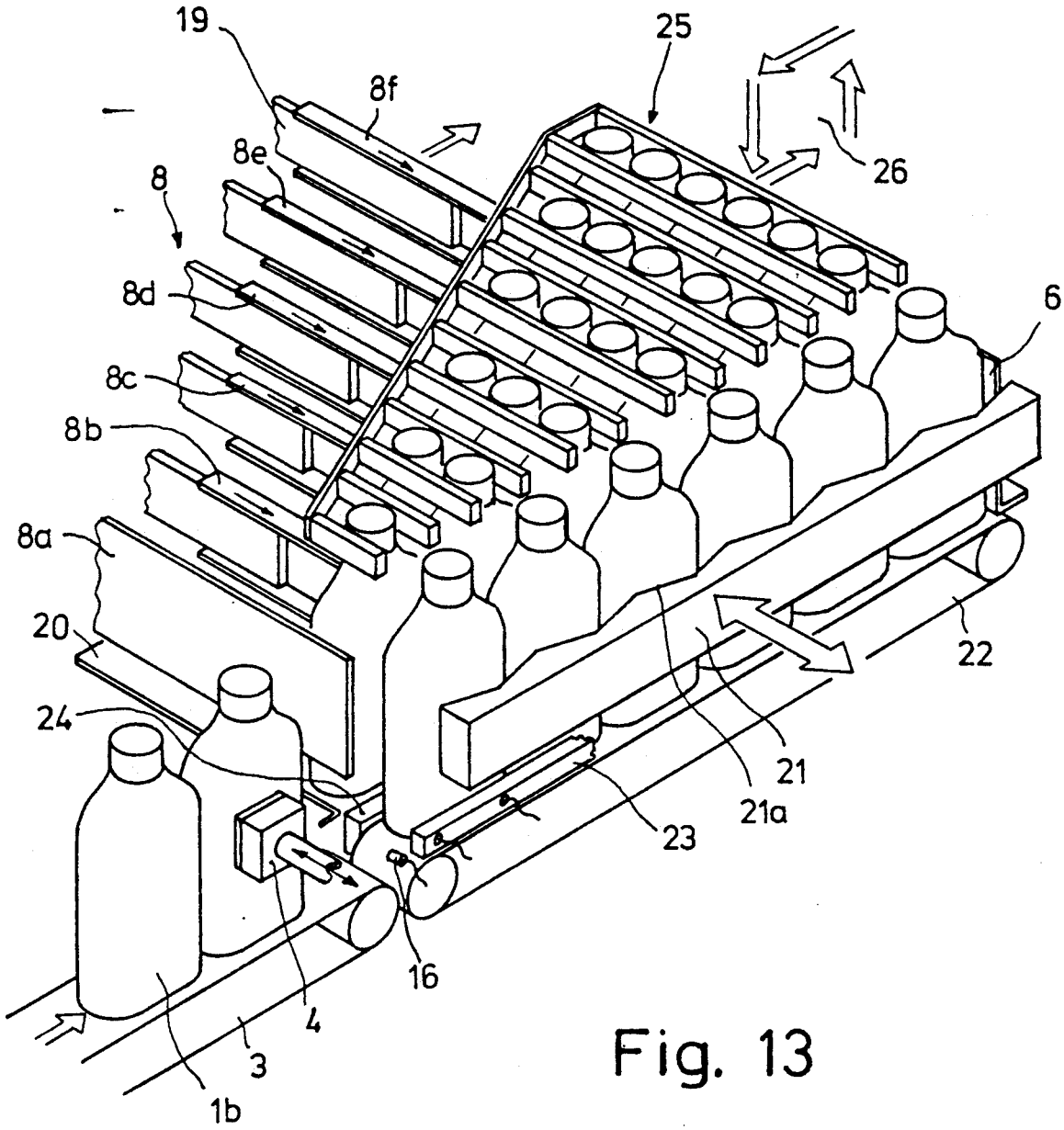
FIG. 13 is a partial perspective view depicting apparatus in accordance with a second embodiment of the invention.
Figure 14:
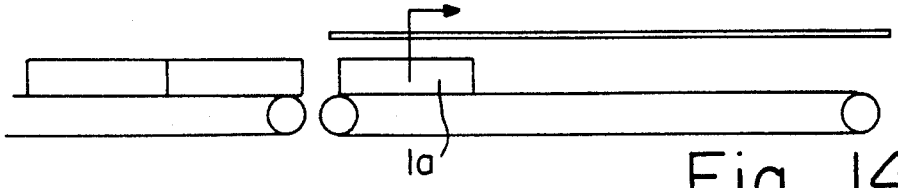
FIGS. 14–17 are views similar to FIGS. 1–4 which schematically depict the stepped grouping of objects in accordance with a futher embodiment of the invention.
Figure 15:
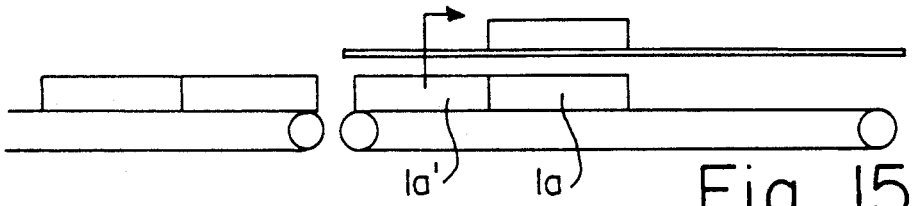
Figure 16:
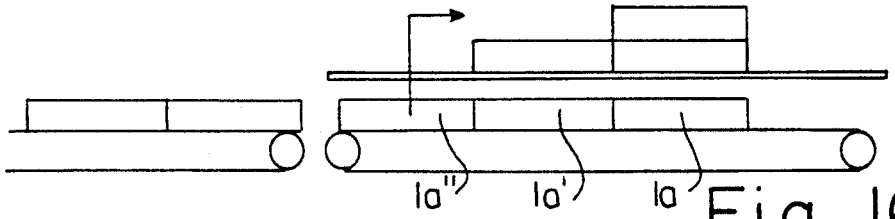
Figure 17:
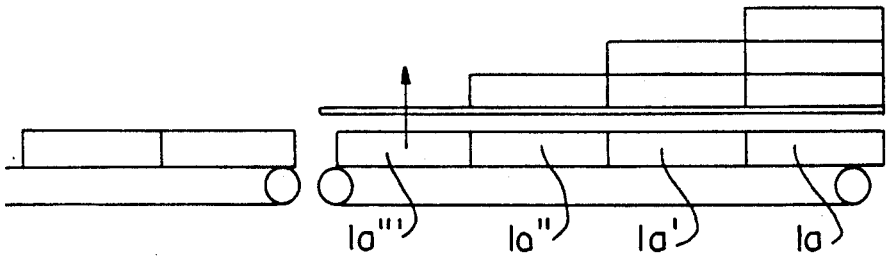

A second embodiment of the present invention is schematically represented in FIG. 13. In FIG. 13 the unit packaging goods **1*b* are bottles which are merged to form packaging groups. In the FIG. 13 embodiment the stepped slide bar assembly 8 is offset by 90°, relative to the arrangement of FIG. 1–12, and is located above a platform 20 onto which the bottles 1*b* are discharged by means of a transversely acting push bar 21. The in-coming bottles 1*b*, upon being released by the barrier 4, are transferred to a conveyor 22 which moves the bottles to a stop 6**.

The method of operation of the apparatus of FIG. 13 is substantially identical to that of the embodiment of FIGS. 1–12. Thus, a stepped formation is first assembled by the delivery, onto the conveyor 22, of bottles lb in steps with the number of bottles in each step serially increasing. These in-coming bottles are maintained in the proper alignment by a pair of opposite disposed boundary rails 23 and 24, the rail 24 being lowered when the bottles are moved transversely by one step under the action of the bar 21. After the stepped formation is completed, the automatic leveling-out occurs by means of the step-wise serial reduction of the number of bottles released by barrier 4. The completed rows are ejected through the action of the stepped slide bar assembly 8 which moves in accordance with the pattern represented at 26. In order to insure operational safety, the bottles lb are tracked between guide rails 25 located at the level of the bottle necks both during discharge from the conveyor device 22 and during the step-wise longitudinal advancement produced by the slide bar assembly 8. The guide rails 25 are mounted from a bracket and are moved synchronously with the movement of the slide bar assembly 8. The push bar 21 is provided with a shape which conforms to the contours of the bottles as shown. It will, of course, be understood that the push bar 21 will e in a lateral standby position when the bottles **1*b* arrive on conveyor 22 so as to not to interfere with the movement of the bottles to the stop 6**.

As in the embodiment of FIGS. 1–12, the dogs **8*b*–8*f* of the stepped slide bar assembly 8 of the FIG. 13 embodiment are of adjustable length in the direction of the push bar 21 in order to be able to engage all of the bottles 1*b* from behind during the automatic leveling-out. This, in part, is accomplished by having the dogs 8*b*–8*f* engage guideways 19** of a pick-up member.

It will be understood that, rather than use the arrangement of guide rails 25 depicted in FIG. 13, configurations of brushes or pleats can be located between the rows of bottles to maintain the requisite relative orientation.

As schematically represented in FIGS. 14–17, the above-described technique can be modified such that, in effect, the stop 6 will move in step-wise fashion during the assembly of the stepped formation. Thus, a single packaging unit may be fed in, moved transversely, retained in the raised position and then advanced longitudinally by one step length. Thereafter, two packaging units may be released onto the conveyor and moved to a position where the leading unit is in registration with the previously received unit. The two units will then be moved transversely, retained in the new position and the partial stepped grouping moved longitudinally by a single step. This mode of operation, of course, requires that the conveyor device 5 or 22 be halted at the appropriate points or that controllable stops be provided on the conveyor device. In accordance with the modified method, the leveling-out procedure would be performed in the manner described above.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for the formation of predetermined groupings of objects on a support plane of a stacking station comprising the steps of:

delivering the objects to the stacking station in step-wise fashion by conveying the objects independently of the stacking station and controllably selectively releasing the said objects to the stacking station, the number of objects delivered in each step serially increasing to a maximum number commensurate with a preselected number of rows of objects and thereafter serially decreasing;

moving the objects received at the stacking station in each delivery step in a first direction until the leading of such objects in the direction of motion reaches a limit position;

periodically translating an object and/or all of the rows of objects which extend upstream from the limit position a preselected distance in a second direction which is transverse to said first direction, the translation being synchronized with the delivery and the movement of the objects in the first direction whereby a translation will occur after each delivery step; and shifting an object and/or rows of objects in the said first direction following each translation, the distance the object and/or rows are shifted being commensurate with the dimension of the object in said first direction.

2. The method of claim 1 wherein said first direction is generally horizontal, said second direction is generally vertical and the step of translating comprises engaging the objects from below to raise them upwardly in the vertical direction and subsequently retaining the objects in the raised position.

3. The method of claim 2 wherein the number of objects delivered increases from one to the maximum number and decreases to one and wherein the shifting of the rows of objects in the first direction causes the objects to move past said limit position.

4. A method for the formation of predetermined groupings of objects on a support plane of a stacking station comprising the steps of:

delivering the objects in a first direction to the stacking station in step-wise fashion by conveying the objects independently of the stacking station and controllably selectively releasing the said objects to the stacking station, the number of objects delivered in each step serially increasing to a maximum number commensurate with a preselected number of rows of objects and thereafter serially decreasing;

translating an object and/or rows of objects a preselected distance in a second direction which is transverse to said first direction, the translation being synchronized with the delivery whereby a translation will occur after each delivery; and shifting an object and/or rows of objects in said first direction following each translation, the distance the object and/or rows are shifted being commensurate with the dimension of said object in said first direction.

5. Apparatus for forming individual objects into groups of objects having a predetermined overall configuration comprising:

first conveyor means for receiving objects to be grouped and moving the received objects in a first direction to a limit position, said first conveyor means being oriented generally horizontally;

feed means for delivering objects to said first conveyor means, said feed means operating in step-wise fashion, the number of objects delivered in each step to said first conveyor means by said feed means serially increasing to a maximum number commensurate with a preselected number of rows of objects and subsequently decreasing from said maximum number;

means for advancing objects in a second direction which is transverse to said first direction, said advancing means being synchronized with said feed means and moving the objects a preselected distance in said second direction, said advancing means imparting reciprocal vertical motion to at least a part of said first conveyor means to raise objects supported on said first conveyor means;

first slide bar means for imparting step-wise motion in said first direction to an object and/or rows of objects which have been advanced in said second direction, the operation of said first slide bar means being synchronized with the operation of said means for advancing whereby a stepped formation of objects is formed and the stepped formation is subsequently leveled-out, wherein said first conveyor means moves the objects to a limit position and said first slide bar means carries objects past the limit position, said first slide bar means imparting motion following advance in said second direction; and means for capturing and retaining objects in the raised position when advanced in the vertical direction by said advancing means.

6. The apparatus of claim 5 wherein said feed means comprises:

in-feed conveyor means; and barrier means for controllably releasing objects from said in-feed conveyor means to said first conveyor means.

7. The apparatus of claim 5 further comprising:

means for sensing the number of objects on said first conveyor means, said sensing means providing signals for controlling the operation of said feed means and said advancing means.

8. The apparatus of claim 5 wherein said first slide bar means comprises a stepped slide bar having a plurality of legs and means for individually varying the lengths of at least some of said legs whereby said slide bar means legs will contact all of the objects of said stepped formation.

9. The apparatus of claim 8 wherein said feed means comprises:

in-feed conveyor means; and barrier means for controllably releasing objects from said in-feed conveyor means to said first conveyor means.

10. The apparatus of claim 9 further comprising:

means for sensing the number of objects on said first conveyor means, said sensing means providing signals for controlling the operation of said feed means and said advancing means.

11. A method for the formation of predetermined groupings of objects on a support plane of a stacking station comprising the steps of:

delivering the objects in a first direction to the stacking station in step-wise fashion, the number of objects delivered in each step serially increasing to a maximum number commensurate with a preselected number of rows of objects and thereafter serially decreasing;

translating an object and/or rows of objects a preselected distance in a second direction which is transverse to said first direction, the translation being synchronized with the delivery whereby a translation will occur after each delivery;

shifting an object and/or rows of objects in said first direction following each translation, the distance the object and/or rows are shifted being commensurate with the dimension of said object in said first direction; and moving the objects received at the stacking station in each delivery step in said first direction until the leading one of such objects in the direction of motion reaches a limit position, the limit position advancing in step-wise fashion as the number of objects delivered serially increases until a maximum limit position which is commensurate with the maximum number of objects delivered per step is reached.

12. Apparatus for forming individual objects into groups of objects having a predetermined overally configuration comprising:

first conveyor means for receiving objects to be grouped and moving the received objects in a first direction to a limit position;

feed means for delivering objects to said first conveyor means, said feed means operating in step-wise fashion, the number of objects delivered in each step to said first conveyor means by said feed means serially increasing to a maximum number commensurate with a preselected number of rows of objects and subsequently decreasing from said maximum number;

means for advancing objects in a second direction which is transverse to said first direction, said advancing means being synchronized with said feed means and moving the objects a preselected distance in said second direction, said advancing means imparting reciprocal vertical motion to at least a part of said first conveyor means to raise objects supported on said first conveyor means; and slide bar means for imparting step-wise motion in said first direction to an object and/or rows of objects which have been advanced in said second direction, the operation of said slide bar means being synchronized with the operation of said means for advancing whereby a stepped formation of objects is provided and the stepped formation is subsequently leveled-out.

13. Apparatus for forming individual objects into groups of objects having a predetermined overall configuration comprising:

first conveyor means for receiving objects to be grouped and moving the received objects in a first direction to a limit position;

feed means for delivering objects to said first conveyor means, said feed means operating in step-wise fashion, the number of objects delivered in each step to said first conveyor means by said feed means serially increasing to a maximum number commensurate with a preselected number of rows of objects and subsequently decreasing from said maximum number;

means for advancing objects in a second direction which is transverse to said first direction, said advancing means being synchronized with said feed means and moving the objects a preselected distance in said second direction; and first slide bar means for imparting step-wise motion in said first direction to an object and/or rows of objects which have been advanced in said second direction, the operation of said first slide bar means being synchronized with the operation of said means for advancing whereby a stepped formation of objects is formed and the stepped formation is subsequently leveled-out and said first slide bar means carries objects past said limit position, said first slide bar means imparting motion following each advance in said second direction, said first slide bar means comprising a stepped slide bar having a plurality of legs and means for individually varying the lengths of at least some of said legs whereby said slide bar means legs will contact all of the objects of said stepped formation.

14. The apparatus of claim 13 wherein said advancing means comprises:

table means; and second slide bar means for transferring objects laterally from said first conveyor means onto said table means.

15. The apparatus of claim 14 wherein said first slide bar means comprises a stepped slide bar having a plurality of legs and means for individually varying the lengths of at least some of said legs whereby said slide bar means legs will contact all of the objects of a stepped formation.

16. The apparatus of claim 14 further comprising:

guide means for maintaining the alignment of the objects during the motion thereof in said second direction.

17. The apparatus of claim 16 wherein said guide means defines a plurality of generally parallel channels and is movable in synchronism with said first slide bar means.

18. The apparatus of claim 13 wherein said feed means comprises:

in-feed conveyor means; and barrier means for controllably releasing objects from said in-feed conveyor means to said first conveyor means.

* * * * *